US005997721A

United States Patent [19]

Limbach et al.

[11] Patent Number: 5,997,721

[45] Date of Patent: Dec. 7, 1999

[54] CLEANING ALUMINUM WORKPIECES

[75] Inventors: Peter Karl Ferdinand Limbach, Goettingen; Armin Kumpart, Bodenfelde, both of Germany; Nigel Cleaton Davies; Jonathan Ball, both of Oxon, United Kingdom

[73] Assignee: ALCAN International Limited, Montreal, Canada

[21] Appl. No.: 08/849,674

[22] PCT Filed: Dec. 18, 1995

[86] PCT No.: PCT/GB95/02956

§ 371 Date: Oct. 16, 1997

§ 102(e) Date: Oct. 16, 1997

[87] PCT Pub. No.: WO96/19596

PCT Pub. Date: Jun. 27, 1996

[30] Foreign Application Priority Data

Dec. 19, 1994 [EP] European Pat. Off. ..... 94309501

[51] Int. Cl.[6] ..... B23H 3/80

[52] U.S. Cl. ..... 205/680; 205/705; 205/711; 205/717; 205/723

[58] Field of Search ..... 205/680, 717, 205/705, 711, 723

[56] References Cited

U.S. PATENT DOCUMENTS

| | | | |
|---|---|---|---|
| 3,929,591 | 12/1975 | Cu et al. | 205/680 |
| 4,097,342 | 6/1978 | Cooke et al. | 204/28 |
| 4,372,831 | 2/1983 | Rosswag | 205/680 |

FOREIGN PATENT DOCUMENTS 1191437 10/1959 France .

*Primary Examiner*—Arun S. Phasge
*Attorney, Agent, or Firm*—Cooper & Dunham LLP

[57] ABSTRACT

A method of cleaning an Al workpiece comprises a.c. anodising the workpiece in an acidic electrolyte capable of dissolving aluminium oxide and maintained at a temperature of at least 70° C. under conditions such that the surface of the workpiece is cleaned with any oxide film thereon being non-porous and no more than about 20 nm thick.

10 Claims, 8 Drawing Sheets

CLEANING ALUMINUM WORKPIECES

This application is a 371 of PCT/GB95/02956 filed Dec. 18, 1995.

There is a considerable volume of data on the cleaning of aluminium workpieces prior to subsequent surface finishing treatments. Some of these are only suitable for batch production as a precursor to, for example, architectural anodising and are not fast enough for continuous high speed operation. A good overview is given in "The Surface Treatment and Finishing of Aluminium and its Alloys" by S Wernick, R Pinner and P G Sheasby, Finishing Publications Ltd, 1987, Teddington, U.K.

Generally aluminium surfaces are cleaned using acid or alkaline solutions. Alkaline etching solutions are faster than acid ones and tend to cope well with residual organics on the surface of the workpiece. Unfortunately, they do not dissolve the magnesium oxides left on the surface of magnesium containing alloys that have been thermally treated. They also often require an acidic desmutting step and very careful rinsing control, and deposits build up rapidly in the bath. The fastest acidic cleaners contain hydrofluoric acid plus another acid such as sulphuric acid. Such known treatments are capable of removing material at rates up to about 1 $g/m^2/min$.

In U.S. Pat. No. 3,718,547, W E Cooke et al. describe a high speed continuous electrolytic surface cleaning treatment of aluminium strip. In a preferred embodiment, the strip is made successively cathodic, anodic and finally cathodic again while being subjected to d.c. electrolysis in a sulphuric acid electrolyte at 90° C. This treatment results in the formation of an anodic oxide film quoted as being 5 to 50 mg per 100 square inches (which corresponds to a film thickness of 30–300 nm assuming an oxide density of 2.5 $g/cm^3$) and which forms an excellent base for lacquer.

In U.S. Pat. No. 4,097,342, W E Cooke et al describe an electrolytic cleaning treatment step which involves subjecting aluminium strip to d.c. anodising for a few seconds at high temperature and current density in a concentrated strong mineral acid electrolyte.

The present invention provides a method of cleaning an Al or Al alloy workpiece which method comprises anodising the workpiece using a chosen a.c. voltage X (expressed in rms V) in an acidic electrolyte capable of dissolving aluminium oxide and maintained at a temperature of at least 70° C. under conditions such that the surface of the workpiece is cleaned with any oxide film thereon being non-porous and having a thickness Y (expressed in nm) wherein Y is not more than about half X, or a thickness of not more than about 20 nm. Preferably the cleaning treatment consists essentially of this step, i.e. without any other special steps being necessary. The following technical explanation may be of interest.

Anodising, whether a.c. or d.c., can produce a wide range of oxide film structures. The type of structure produced is generally dependent on the voltage applied across the film at the surface and the aggressiveness of the electrolyte. Thus in a non-aggressive electrolyte only a barrier film is grown that reaches a limiting thickness governed by the voltage applied, i.e. a limiting field is achieved that will no longer drive ions through the film. However, if the electrolyte can dissolve the film then, once the normal barrier film thickness is achieved, cells are formed on the surface that each have a pore in the centre. The oxide film at the base of these pores continues to grow into the metal and be dissolved rapidly at the electrolyte-film interface thus maintaining the barrier film thickness. Dissolution at the base of the pores is greatly enhanced over the normal chemical dissolution rate by the electric field which results in the columns of oxide between the bases of the pores being left unattacked or 'growing' to form the cell walls. In an aggressive acid, such as sulphuric or phosphoric acid, the structure formed is strongly dependent on the temperature and acid concentration. Thus at room temperature the dissolution in the pore is so slow that low currents are used and films can be made many microns thick without the original outer surface being significantly attacked, e.g. architectural finishes and films of the kind described in EP 0178831 are produced at low temperatures. At higher temperatures only thin films can be grown before the outer surface is attacked, however, these films can be grown very rapidly as the dissolution in the pores is considerable; this is used to advantage when high speed anodising to pretreat metal strips such as the processes described in EP 0181183. The pores in these films tend to be more open and in extreme cases adjacent pores will merge leaving only filaments of the pore wall behind. This is commonly seen in phosphoric acid films used for pretreatment.

If the acid is made even more aggressive then a point is reached at which the rate of film dissolution is greater than the rate of formation and a 'bare' surface results. However, as the rate of film dissolution is electric field enhanced the speed of etching is very fast indeed and the process lends itself to high speed cleaning volume production. In addition, when a.c. power is employed copious quantities of hydrogen are evolved in the cathodic half cycle and smut (whether deriving from alloying elements, e.g. silicon or copper, metal fines or organic residues) is blown off the surface leaving a surface that is cleaner than just pickling in the hot acid would achieve.

Aluminium metal in air carries a naturally occurring oxide film some 2.5 nm thick at room temperature. The barrier layer formed when Al is anodised in a non-aggressive electrolyte has a limiting thickness (expressed in nm) of some 1.0 to 1.4 times the anodising voltage. The cleaning method of this invention is generally performed under conditions such that any oxide film on the surface of the workpiece at the end of the treatment is no more than about half the barrier layer thickness that might have been predicted using this formula from the anodising voltage employed. Preferably any residual oxide film is less than 10 nm thick, e.g. less than 2.5 nm thick. Thus any oxide film on the surface of the Al workpiece at the end of the cleaning treatment is very thin.

The cleaning method can be carried out in conventional baths used (under different conditions particularly lower electrolyte temperatures) for a.c. anodising. In an a.c. treatment, it is envisaged that a surface anodic oxide film is grown during the anodic part of the cycle. Dissolution occurs during both parts of the cycle and an equilibrium is set up whereby the rates of growth and dissolution are the same and the barrier thickness of any anodic oxide film remains constant. It is thought likely, though not certain, that a thin anodic oxide film is always present. A graph of current density against time for a.c. anodising at constant voltage suggests that this equilibrium is reached in 0.3 to 3.0 s. When a.c. is used with graphite counter-electrodes the frequency is preferably greater than 25 Hz. Other inert or noble metals or metal oxides can be used as counter-electrodes.

The temperature at which the rate of film dissolution is greater than the rate of formation, so that a.c. anodising effectively cleans the surface, is always at least 70° C. usually at least 75° C. But in any particular case the minimum temperature required to achieve this technical effect is dependent on a number of factors:

The nature of the acidic electrolyte. This electrolyte must always be one having some dissolving power for aluminium oxide. Phosphoric acid and sulphuric acid-based electrolytes are preferred. Phosphoric acid electrolytes are chemically more aggressive and minimum cleaning temperatures for commonly used alloys are lower, e.g. in the range of 80 to 95° C. Minimum cleaning temperatures for commonly used alloys in sulphuric acid are typically 92 to 96° C. Mixed acid electrolytes are not preferred, on account of the difficulty of recycling/regenerating such mixtures.

The term phosphoric acid is here used to cover a family of related acids based on various phosphorus oxides. This family includes orthophosphoric acid $H_3PO_4$, metaphosphoric acid and pyrophosphoric acid based on $P_2O_5$; and also phosphorous or phosphonic acid $H_3PO_3$; hypophosphorous or phosphinic acid $H_3PO_2$; and perhaps others. As electrolytes with dissolving power for aluminium oxide they all have generally similar properties, and are here included under the generic name phosphoric acid.

The term Al is herein used to denote pure aluminium metal and alloys containing a major proportion of aluminium. The nature of the Al alloy is not material to the invention. But the composition of the Al alloy, and particularly the Mg content, does have a material effect on the minimum cleaning temperature. This can be illustrated by reference to the automotive alloys AA6111 and AA5754 (of The Aluminum Association Inc. Register of April 1991). In contrast to AA1050A lithographic sheet, these materials contain magnesium at 0.5–1.0 wt % and 2.6–3.6 wt % respectively. This has two significant effects. Firstly the surface finish after rolling of these materials is much more broken up due to the presence on the surface of mixed aluminium and magnesium oxides and alloying metal. This is caused by a thick magnesium oxide film growing on the surface of the ingot during homogenisation which in turn causes excessive 'pick up' during hot rolling. These picked-up metal/oxide particles are redeposited on the strip during rolling. The thickness of these particles is up to approximately 1 micron for 6111 and 2.5 microns for 5754 and for many subsequent operations they have to be at least partially removed. In order to clean these materials a higher current density, e.g. 2–5 $kAm^{-2}$, is required than for lithographic sheet, in order to achieve the necessary surface removal in an acceptably short time for a continuous process.

The second major effect of the magnesium content of the alloy is that it strongly affects the rate of dissolution. Consequently under anodising conditions the film growth rate is faster for higher magnesium containing alloys but the barrier film is thinner under identical conditions.

There is no sharp cut-off point at which dissolution exceeds film growth rate. The strong factors are temperature and magnesium content of the alloy. Also important but lesser influences within the window of conditions that are desirable for continuous operation are:

Acid concentration. Phosphoric and sulphuric acid concentration is preferably 5–35% by weight, e.g. 15–25%. Aluminium content of the electrolyte should preferably be kept below 10 g/l (of Al ion) in phosphoric acid electrolytes and below 20 g/l in sulphuric acid, since higher levels may cause a damaging decrease in conductivity.

Wave form type. The wave form may be sinusoidal or not as desired. Although deliberate bias is not preferred, the a.c. current may be biased in either the cathodic or anodic direction. The a.c. frequency is at least several cycles per second and is preferably the commercial frequency.

Voltage. A.C. voltages expressed herein are rms voltages measured (unless otherwise stated) at the workpiece. Particularly in commercial operation, voltage of the power source may be significantly higher than this. While the potential across the surface of the workpiece is important, it is in practice often easier to measure the voltage at the power source. Preferred voltages (at the power source) are in the range of 0.5–100 volts. Below 50 V, the risk to users is reduced. At an anodising voltage of 20 V (at the workpiece), any oxide film remaining on the surface of the cleaned Al workpiece is expected to be not more than 10 nm thick.

It is generally easier to monitor current density rather than voltage. Although the relationship between the two depends on the equipment being used, the following relationship has been found useful in the inventors laboratory. A current density of N $kAm^{-2}$ often corresponds to an a.c. anodising voltage of about 4N to 6N V.

Preferred current densities are in the range of 0.1–10 $kAm^{-2}$. As noted above, the higher current densities may be required for alloys containing Mg. When higher current densities are used, minimum cleaning temperatures are generally higher for any given alloy.

As shown in the examples below, the cleaning method of this invention is capable of removing material from the Al workpiece at a rate of 5.5–10.5 $g/m^2/min$. This is some 5.5–10.5 times faster than is achieved in any existing acidic cleaning process. This advantage is particularly valuable when the workpiece is an Al sheet or strip which is subjected to rapid continuous cleaning by immersion in electrolyte for a short period e.g. 0.1–10 seconds.

The processes occurring when using a.c. are:

i) Cathodic gassing ($2H^+ + 2e^- \rightarrow H_2$) that cleans loose detritus off the surface. A demonstration of this is to immerse AA6111 alloy in hot phosphoric acid without power applied. The dissolving surface leaves behind a copper containing black smut. Application of power will remove this or if the surface was not immersed for long before power was applied the smut does not have time to form.

ii) Field enhanced chemical dissolution. This occurs in both the anodic and cathodic cycles. The presence of a field stretches Al—O bonds and allows for easier attack.

iii) Film growth which of course occurs in the anodic cycle.

So in the anodic cycle ii) and iii) compete and naturally greater dissolution is expected in the cathodic cycle.

BRIEF DESCRIPTION OF THE DRAWINGS

Reference is directed to the accompanying drawings in which.

The following Examples illustrate the invention.

EXAMPLE 1

A commercial anodising plant was operated under the following conditions for cleaning lithographic sheet (AA1050A). The conditions were:

Acidic strength—20 wt % phosphoric acid

Time (under electrodes)—0.4–1.0s

Temperature—85° C.

Current density—1 $kAm^{-2}$ (a.c.)

Voltage—about 20 V (a.c.) at the power supply.

The resulting surface finish has been the subject of a study which has shown that the surfaces produced are as free of organic contaminants as any industrial finish examined to date, and have a thinner film on the surface than the natural oxide thickness. Consequently over the two weeks following cleaning this film thickens up to the natural thickness of 2.5 nm.

EXAMPLE 2

Sheet samples of 0.3 mm gauge AA1050A were treated in a 20 wt % phosphoric acid solution at a current density of 3 $kAm^2$ a.c. for 5 s at various temperatures. This alloy was chosen as it has a very low level of magnesium and therefore the threshold temperature at which dissolution begins to exceed anodic film growth should be at its maximum. At 80° C. a porous anodic film was formed on the surface but at 85° C. only a thin barrier film was produced indicating that the limiting barrier film thickness was not attained for the current density employed.

EXAMPLE3

As noted above, there is not a sharp cut-off point at which dissolution exceeds film growth rate. However at commercially relevant current densities, control of the growth of a filamented anodic oxide film would be difficult much above 70° C. especially on a high magnesium alloy, while reliable cleaning with respect to obtaining a thin film on the surface may require temperatures of at least 85° C. For high magnesium alloys a temperature as low as 80° C. may be practically possible. Thus commercially pure material such as AA1050A lithographic sheet requires 85° C. (see Example 2), as does AA6111, for even though it has some magnesium in the alloy it also requires a higher current density to obtain rapid cleaning and will grow a film at 80° C.

Two different alloys were subjected to electrolytic cleaning by the method of this invention in laboratory equipment under the following conditions:

Acid strength—20 wt % phosphoric acid

Time—1–6s

Temperature—80° C. or 90° C.

Current density—5 $kA/m^2$ a.c.

Voltage—approximately 20 V at 80° C. and 15 V at 90° C.

Figure 1:
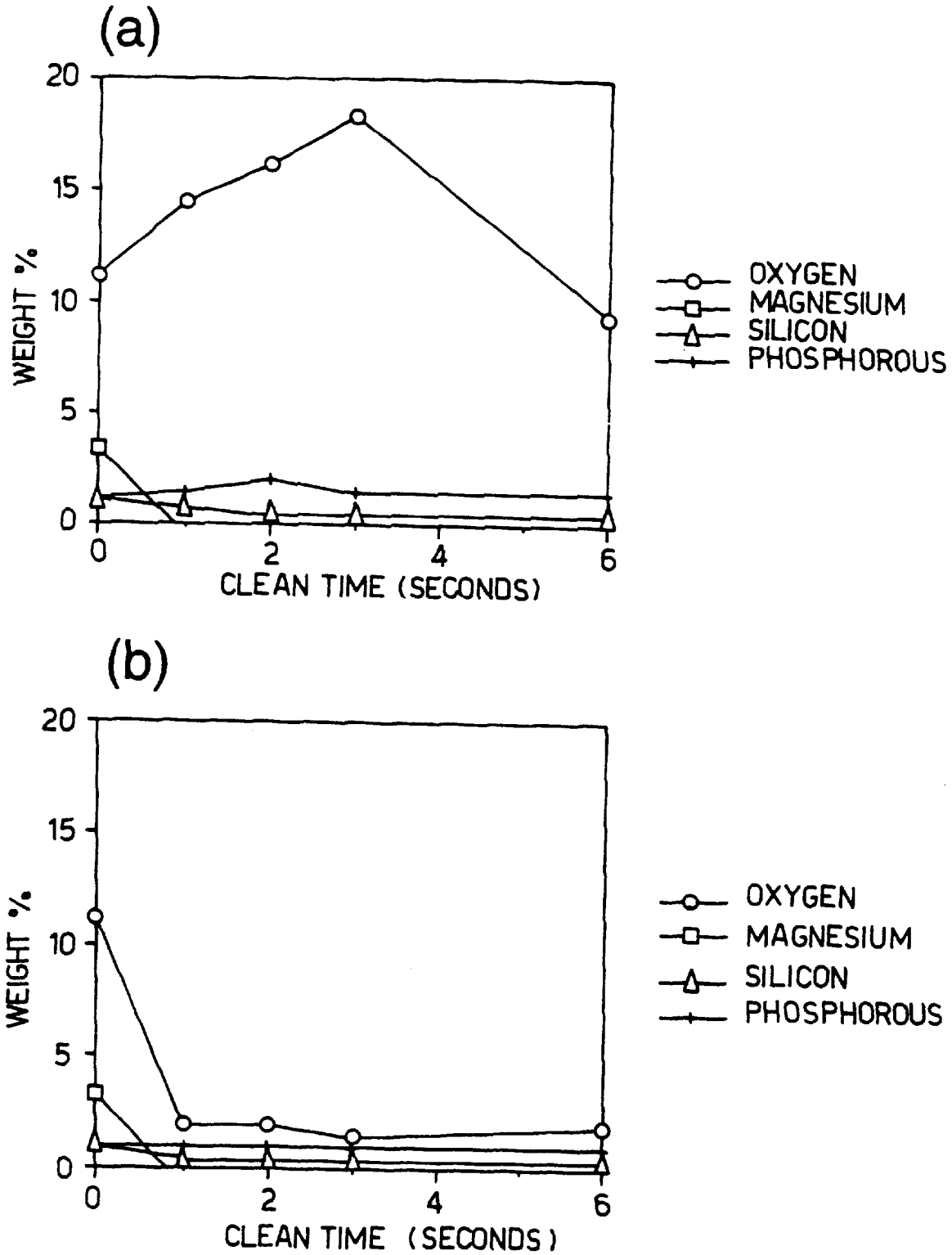
FIGS. 1(*a*) and (*b*) comprise two graphs shown as (*a*) and (*b*) illustrating the surface concentrations of oxygen and magnesium (as measured by electron microprobe) for AA6111 electrolytically cleaned at (a) 80° C. and (b) 90° C.

Results for AA6111 alloy are shown in FIG. 1. Graph (a) shows surface concentrations of four elements, determined by electron probe area analysis, after electrolytic cleaning at 80° C. for 1 to 6 s. The significant reading for oxygen indicates the presence of an anodic oxide film of significant thickness.

By contrast, Graph (b) shows the results obtained after electrolytic cleaning at 90° C. The absence of oxygen indicates that an oxide film was either absent or was present only at very low thickness.

Figure 2:
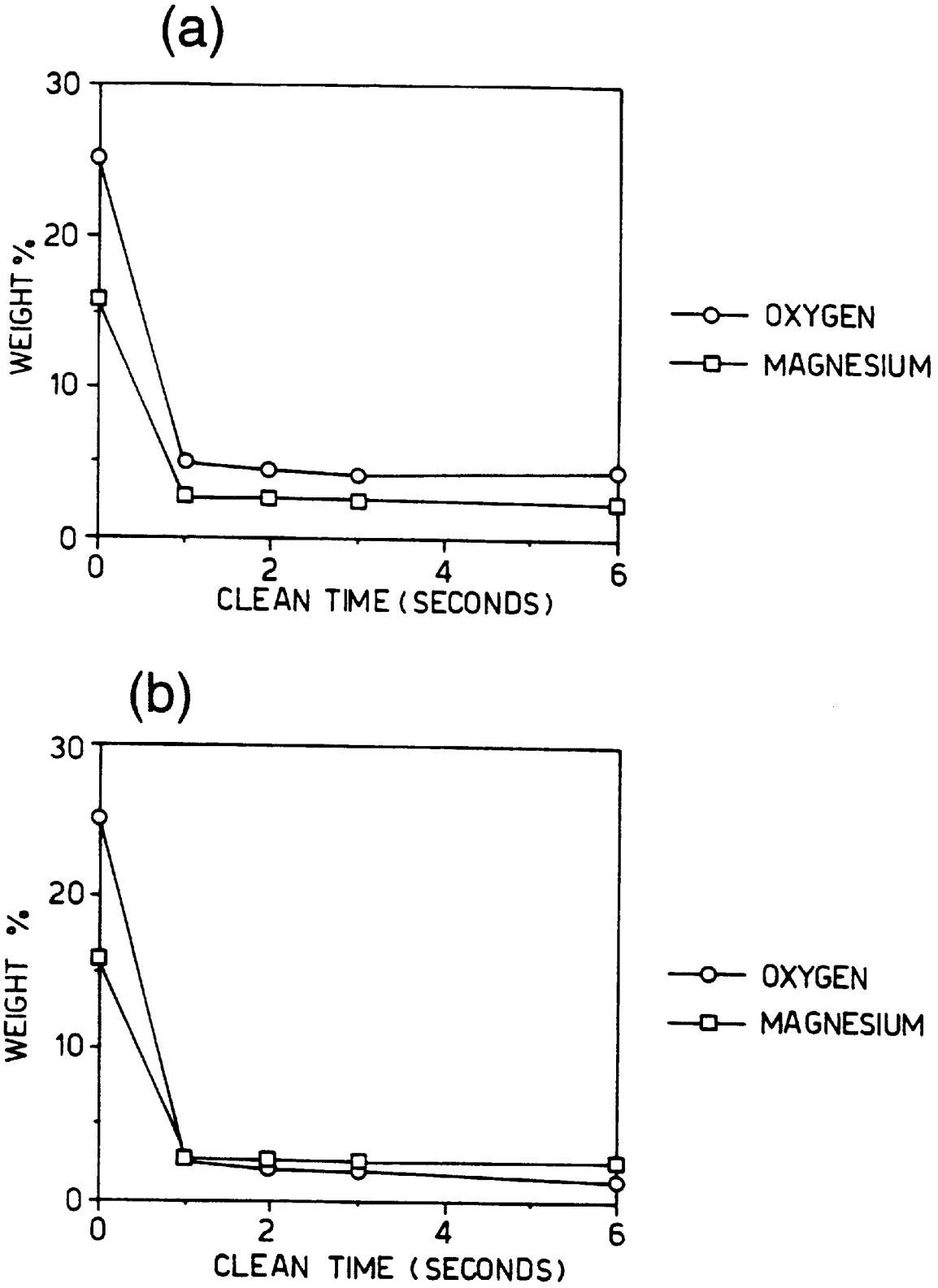
FIGS. 2(*a*) and (*b*) consist of two corresponding graphs for AA5754 alloy.

FIG. 2 shows comparable results for 5754 alloy. At both 80° C. and 90° C., the method was effective to electrolytically clean the surface of the workpiece.

Figure 3:
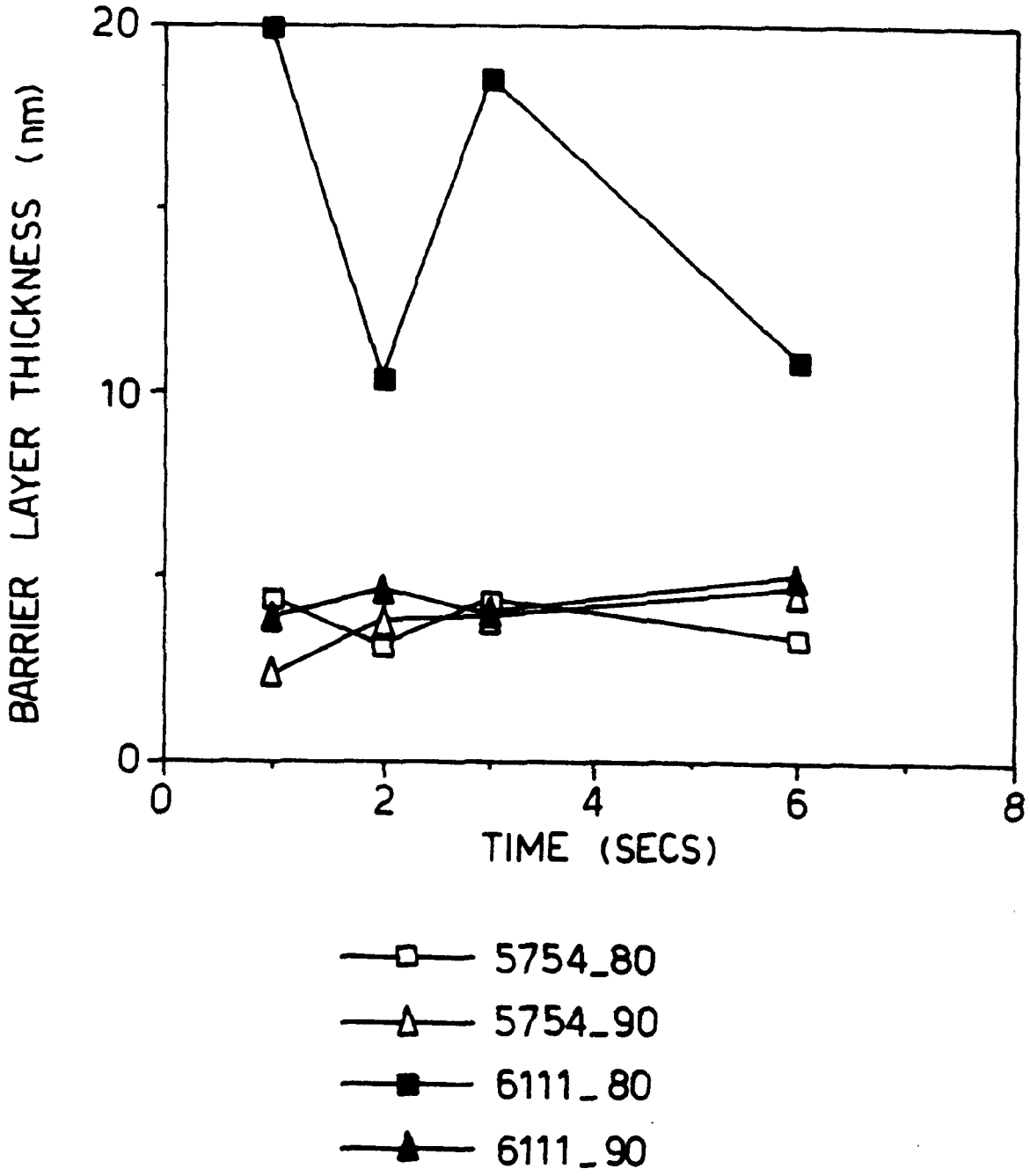
FIG. 3 is a graph of barrier layer thickness measurements for AA5754 and AA6111, electrolytically cleaned for 1, 2, 3 and 6 seconds.

FIG. 3 is a graph showing barrier layer thickness a.c. impedance measurements of the same cleaned surfaces as in FIGS. 1 and 2, namely AA5754 cleaned at 80° C. and 90° C., and AA6111 treated at 80° C. and 90° C. The AA6111 sample which had been treated at 80° C. had a residual oxide layer more than 10 nm thick. The other three samples had residual barrier layers less than 5 nm thick.

EXAMPLE4

The same alloys AA5754 and AA6111 were a.c. electrolytically cleaned in 20 wt % phosphoric acid in laboratory equipment for 2 minutes. The cleaning conditions and the results obtained are set out in Table 1. Voltage figures were measured at the electrodes of the tank. Attention is directed to the column headed "weight loss" where the figures are some 5 to 10 times the size of any achieved previously in acid cleaning.

TABLE 1

Effect of Prolonged Phosphoric Acid Cleaning on Substrate Weight Loss and Surface Carbon

| Alloy | Current Density $kA/m^2$ | Bath Voltage (V) | Temp. (° C.) | Weight Loss ($g/m^2/min$) | Surface Carbon ($mg/m^2$) |
|---|---|---|---|---|---|
| 5754 | 5 | 20 | 80 | 9.51 ± 0.18 | 1.62 ± 0.31 |
| | | 15 | 90 | 10.31 ± 0.22 | 1.29 ± 0.31 |
| 6111 | 3 | 12.5 | 80 | 5.5 ± 0.16 | 1.05 ± 0.24 |
| | | 10 | 90 | 5.82 ± 0.16 | 1.09 ± 0.22 |

EXAMPLE 5

Commercial anodising equipment using a sulphuric acid electrolyte was operated under different conditions to electrolytically clean AA8011 closure stock. The conditions used were:

Acid strength—18 wt % sulphuric acid

Time (in bath)—3s

Current density—2 $kAm^{-2}$ (a.c.)

Voltage—6 V at the power supply.

The temperature was varied, and it was found that there was a quite rapid switch-over from anodising to cleaning at temperatures above 90° C. A temperature of 95° C. was chosen as the minimum effective cleaning temperature under these conditions for this alloy.

EXAMPLE 6

Some other AA6000 series experimental materials were treated under conditions that were shown to produce a thin barrier film on 6111, (see Example 3). These were:

Acid Strength—20 wt % phosphoric acid
Time 3s
Temperature—90° C.
Current Density—2 and 3 kA/m$^2$ a.c.
Voltage—approximately 7 V and 10 V (for 2 and 3 kAm$^{-2}$ respectively) measured at the tanks electrodes.

The alloys employed were AA6009 and two variants of AA6016, namely a low copper variant (0.01%), labelled 6016A, and a medium specification range copper variant (0.1%), labelled 6016B and having the characteristics:

| | Cu | Fe | Mg | Mn | Si | Ti | Grain Size μm |
|---|---|---|---|---|---|---|---|
| 6016A | 0.01 | 0.28 | 0.42 | 0.08 | 1.17 | 0.01 | 21 × 32 |
| 6016B | 0.10 | 0.29 | 0.40 | 0.08 | 1.22 | 0.01 | 22 × 32 |

Process Route
Homogenise 18h 560° C. (4h)
Hot Roll 5.0 mm (335° C.)
Cold Roll 1.2 mm (76%)
CASH anneal 540° C.

The following film thicknesses (in nm) were found after treatment:

| Alloy | 2 kA/m$^2$ | 3 kA/m$^2$ |
|---|---|---|
| 6009 | 5 | 6 |
| 6016A | 6 | 5 |
| 6016B | 6 | 5 |

All these films are regarded as thin.

EXAMPLE 7

Pairs of samples of 1050A and 5182 were connected across an a.c. power supply and anodised against each other in 20 wt % phosphoric acid at various voltages and temperatures. The voltages were measured at the workpiece. The run length was 10 s. After this the samples were subjected to a.c. impedance measurement to determine the steady state barrier layer.

Figure 4:
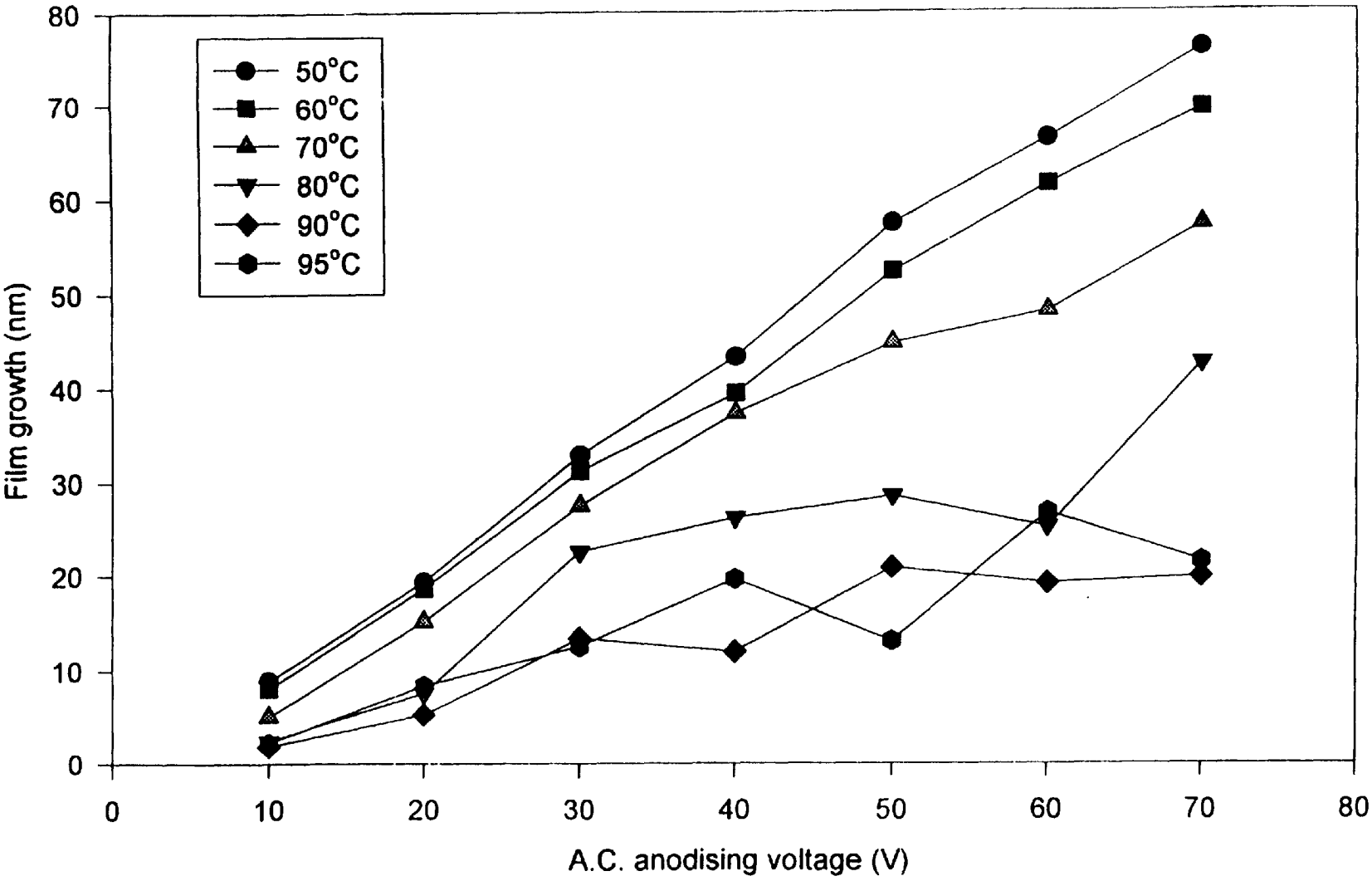
FIG. 4 is a graph to show actual film growth against anodising voltage (a.c.) for 1050A (0.3 mm) at different temperatures in 20% $H_3PO_4$.

FIG. 4 shows the barrier film growth of 1050A. The films generally are thinner at lower voltage and higher temperature. The cleaning treatments performed at 80° C. and above are in accordance with this invention, while those performed at lower temperatures are not.

Figure 5:
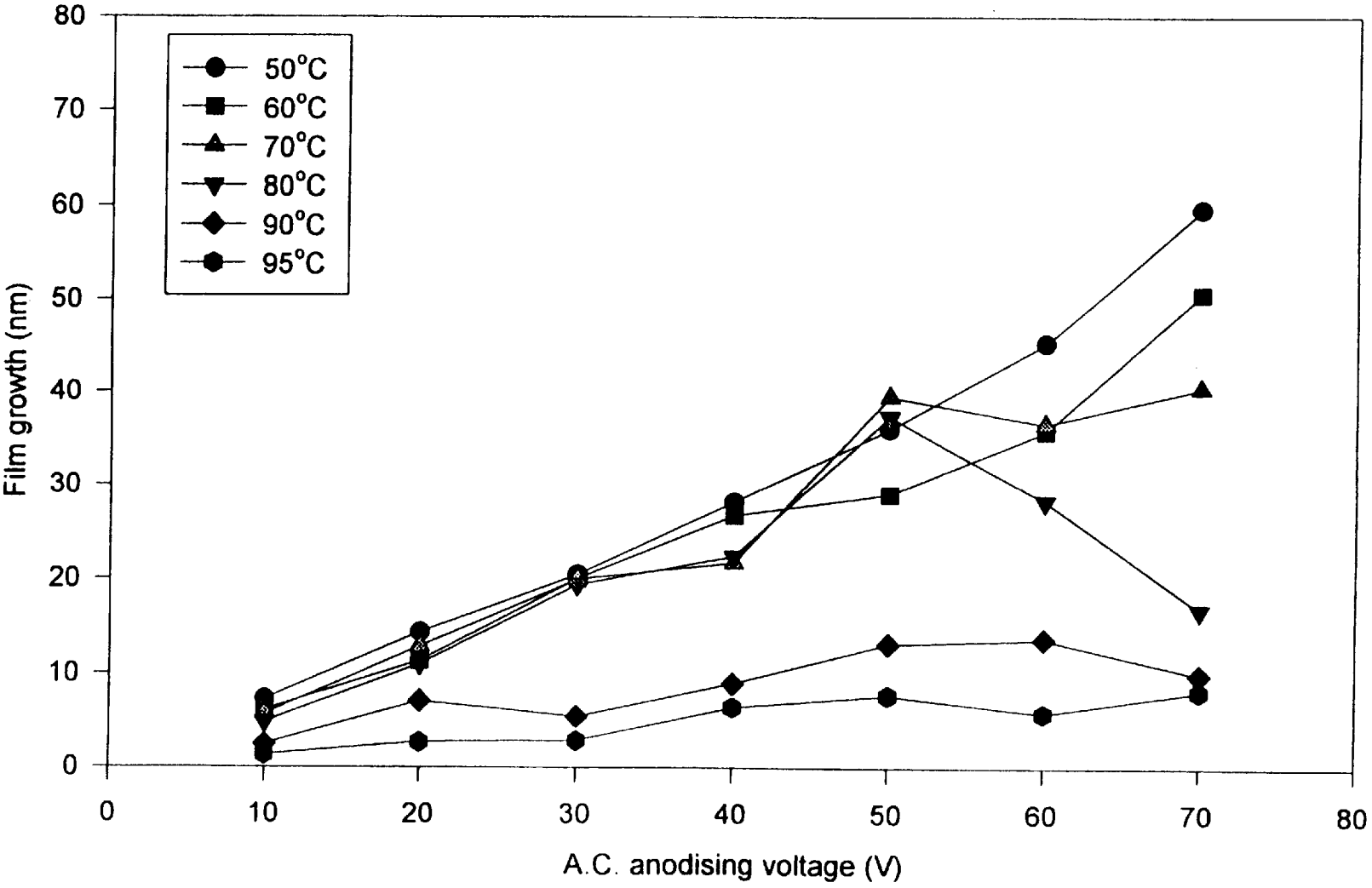
FIG. 5 is a graph to show actual film growth against anodising voltage (a.c.) for 5182 (0.3 mm) at different temperatures in 20% $H_3PO_4$.

FIG. 5 shows the barrier film growth for 5182 under similar conditions. The film thicknesses are generally less than their 1050A counterparts. Cleaning treatments performed at 90° and 95° C. are in accordance with the present invention.

EXAMPLE 8

This was performed as described in Example 7, except that the acid was changed to 20 wt % phosphonic acid (phosphorous acid).

Figure 6:
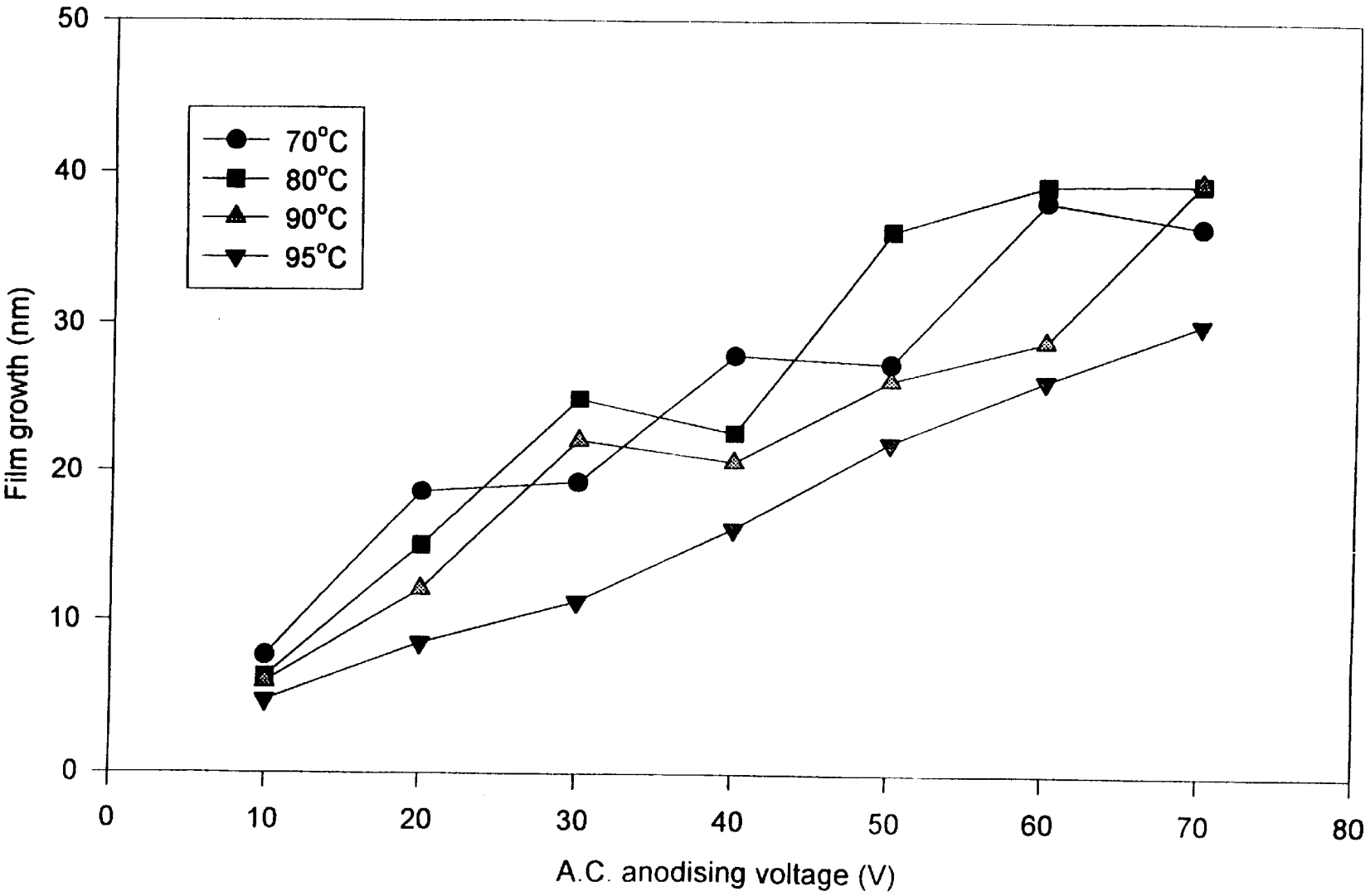
FIG. 6 is a graph to show actual film growth against anodising voltage (a.c.) for 1050A (0.3 mm) at different temperatures in 2.04 molar $H_3PO_3$.
Figure 7:
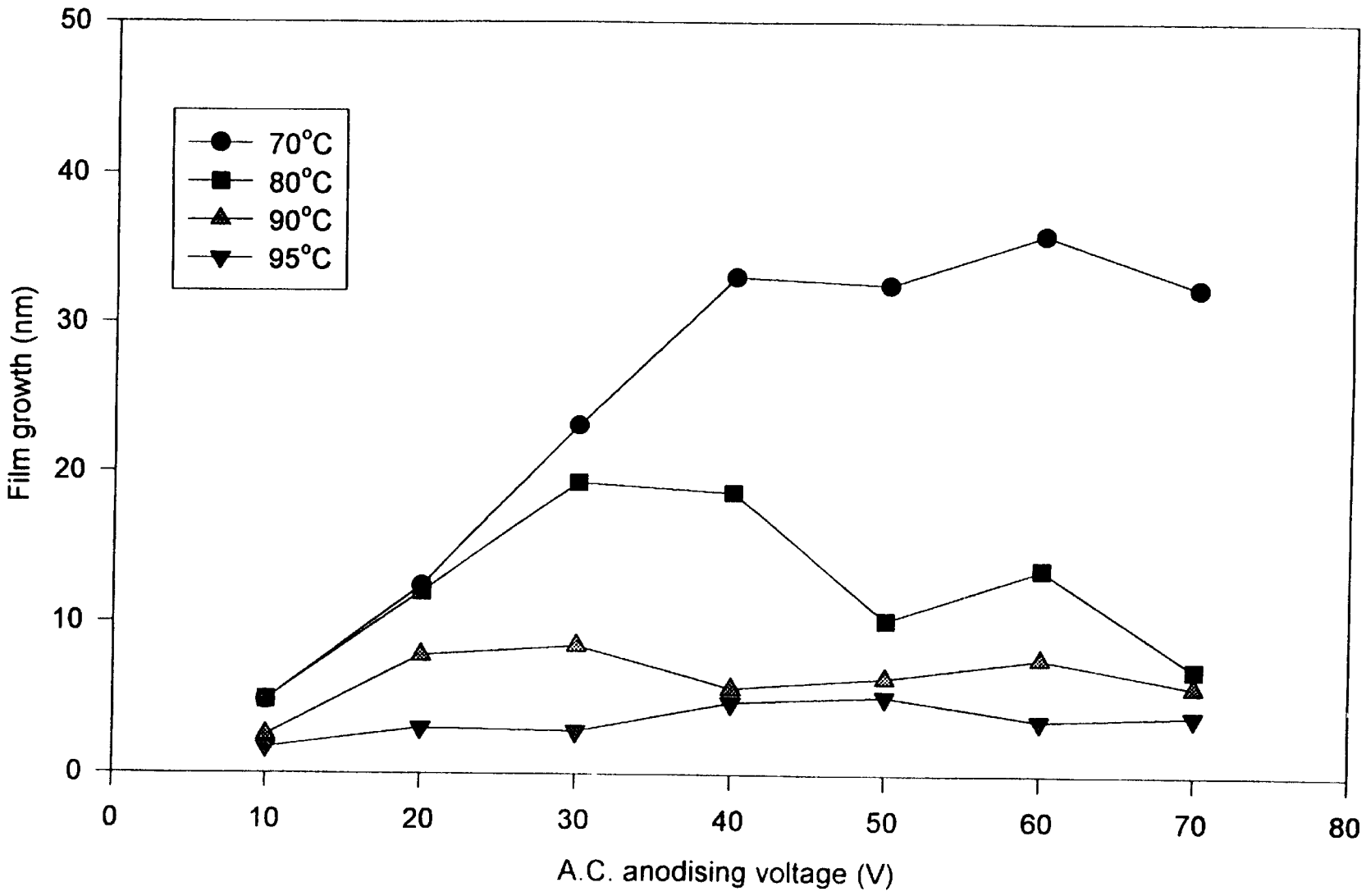
FIG. 7 is a graph to show actual film growth against anodising voltage (a.c.) for 5182 (0.3 mm) at different temperatures in 2.04 molar $H_3PO_3$.

FIG. 6 shows the film growth for 1050A and FIG. 7 shows the film growth for 5182.

EXAMPLE 9

Figure 8:
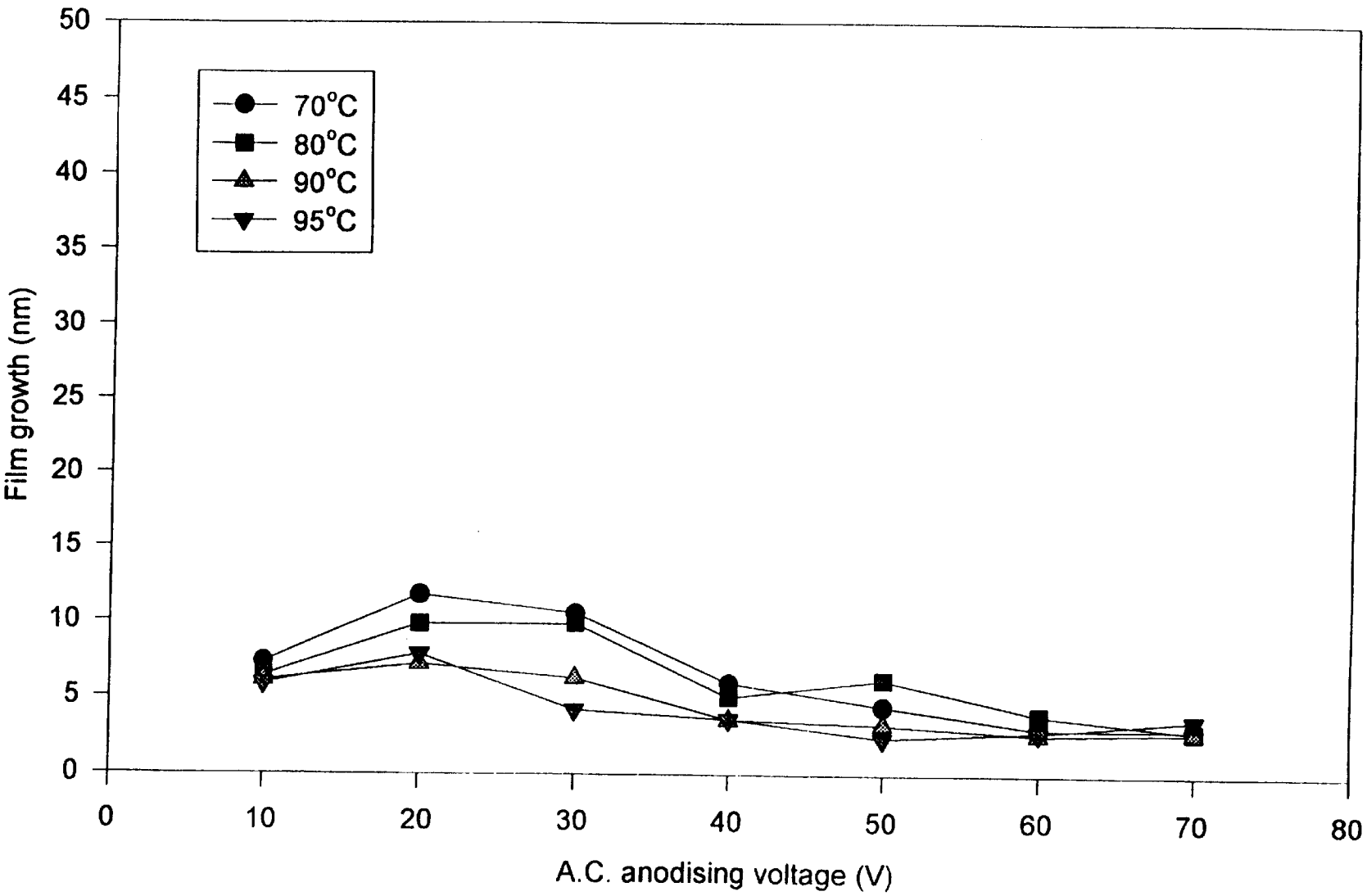
FIG. 8 is a graph to show actual film growth against anodising voltage (a.c.) for 5182 (0.3 mm) at different temperatures in 2.04 molar $H_2SO_4$.

This was performed as described in Example 7, except that the acid was changed to 20 wt % sulphuric acid. FIG. 8 shows film growth for 5182.

We claim:

1. A method of cleaning an Al or Al alloy workpiece which method comprises anodising the workpiece at a chosen a.c. voltage X (expressed in rms V) in an acidic electrolyte containing phosphoric acid or sulphuric acid capable of dissolving aluminium oxide and maintained at a temperature of at least 80° C. for high magnesium alloys and at least 85° C. for all other alloys under conditions such that the surface of the workpiece is cleaned with any oxide film thereon being non-porous and having a thickness Y (expressed in nm) wherein Y is not more than about half X.

2. A method as claimed in claim 1, wherein the anodising is continued until an equilibrium is reached between oxide film formation and dissolution.

3. A method as claimed in claim 1, wherein the workpiece is Al sheet.

4. A method as claimed in claim 1, wherein the electrolyte is at a temperature of 80–100° C. and a.c. anodising is continued for 0.1–10s at a current density of 0.1–10 kAm$^{-2}$.

5. A method as claimed in claim 1, wherein any oxide film on the cleaned surface of the workpiece is no more than 10 nm thick.

6. A method of cleaning an Al or Al alloy workpiece which method comprises anodising the workpiece at a chosen a.c. voltage in an acidic electrolyte containing phosphoric or sulphuric acid capable of dissolving aluminium oxide and maintained at a temperature of at least 80° C. for high magnesium alloys and at least 85° C. for all other alloys under conditions such that the surface of the workpiece is cleaned with any oxide film thereon being non-porous and having a thickness of not more than about 20 nm.

7. A method as claimed in claim 6, wherein the anodising is continued until an equilibrium is reached between oxide film formation and dissolution.

8. A method as claimed in claim 6, wherein the workpiece is Al sheet.

9. A method as claimed in claim 6, wherein the electrolyte is at a temperature of 80–100° C. and a.c. anodising is continued for 0.1–10s at a current density of 0.1–10 kAm$^{-2}$.

10. A method as claimed in claim 6, wherein any oxide film on the cleaned surface of the workpiece is no more than 10 nm thick.

* * * * *